US006690799B1

(12) United States Patent
Iwase et al.

(10) Patent No.: US 6,690,799 B1
(45) Date of Patent: Feb. 10, 2004

(54) STEREO SIGNAL PROCESSING APPARATUS

(75) Inventors: Hiroshi Iwase, Kanagawa-ken (JP); Takahiro Kubota, Kanagawa-ken (JP)

(73) Assignee: Koninklijke Philips Electronics N.V., Eindhoven (NL)

( * ) Notice: Subject to any disclaimer, the term of this patent is extended or adjusted under 35 U.S.C. 154(b) by 788 days.

(21) Appl. No.: 09/588,388

(22) Filed: Jun. 6, 2000

(30) Foreign Application Priority Data

Jun. 9, 1999 (JP) ..... 11-163074

(51) Int. Cl.[7] ..... H04R 5/00
(52) U.S. Cl. ..... 381/17; 381/1
(58) Field of Search ..... 381/17, 1

(56) References Cited

U.S. PATENT DOCUMENTS 5,970,153 A * 10/1999 Petroff ..... 381/17
6,111,958 A * 8/2000 Maher ..... 381/17
6,285,767 B1 * 9/2001 Klayman ..... 381/17

* cited by examiner

*Primary Examiner*—Minsun Oh Harvey
*Assistant Examiner*—Devona E Faulk
(74) *Attorney, Agent, or Firm*—Michael E. Schmitt

(57) ABSTRACT

To realize a stereo signal processing apparatus which effectively removes vocal signals, without degradation of stereo effect, with a simple construction.

The stereo signal processing apparatus, which removes vocal signals included in right and left input signals, comprises right filter means 121, 122 for extracting a right low-frequency signal and a right high-frequency signal from a right input signal, left filter means 111 and 112 for extracting a left low-frequency signal and a left high-frequency signal from a left input signal, subtraction means 131 for performing subtraction between the right input signal and the left input signal to generate a vocal removal signal, right addition means 123 for adding the right low-frequency signal and the right high-frequency signal from said right filter means to the vocal removal signal from said subtraction means so as to generate a right output signal, a left addition means 113 for adding the left low-frequency signal and the left high-frequency signal from said left filter means to the vocal removal signal from said subtraction means so as to generate a left output signal. The right filter means and the left filter means comprise filters having filter types different from each other.

3 Claims, 7 Drawing Sheets

STEREO SIGNAL PROCESSING APPARATUS

The present invention relates to a stereo signal processing apparatus, and more particularly, to a stereo signal processing apparatus having a vocal cancel function to remove vocal signals included in left and right input signals.

Conventionally, as a circuit to cancel vocal components (vocal signals) from left and right input stereo signals mixedly including vocal and instrumental plays and obtain a monophonic play signal, a circuit as shown in FIG. 7 is employed.

This circuit has a left low-pass filter 11 that extracts a left low-frequency signal and a left high-pass filter 12 that extracts a left high-frequency signal, from a left input signal (Lin), a right low-pass filter 21 that extracts a right low-frequency signal and a right high-pass filter 22 that extracts a right high-frequency signal, from a right input signal (Rin), subtraction means 31 that performs subtraction between the right input signal (Rin) and the left input signal (Lin) to generate a vocal removal signal, left addition means 13 that adds the left low-frequency signal and the left high-frequency signal to the vocal removal signal to generate a left output signal (Lout), and right addition means. 23 that adds the right low-frequency signal and the right high-frequency signal to the vocal removal signal to generate a right output signal (Rout).

Note that at this stage, explanation will be made on the presumption that numerals 41 to 44 do not exist in FIG. 7.

First, the left and right filters respectively extract a low-frequency signal and a high-frequency signal except an intermediate frequency including a vocal signal in advance. At this stage, the vocal signal is not included, further, an intermediate component significant as music is missing. Then, the subtraction between the left input signal and the right input signal cancels the vocal signals precisely located around the center of the stereo signals, and generates a vocal removal signal. In the vocal removal signal, the vocal signals are canceled, but signal components having different phases remain in the left and right signals. Then, the vocal removal signal is added to the respective left and right low-frequency signals and high-frequency signals, to generate stereo signals where all the frequency components are included and the vocal signals are removed.

In the above circuit, to cancel the vocal signals, the intermediate component significant as music is generated by the subtraction means 31. Accordingly, the intermediate component is a single signal, i.e., a monophonic signal. The monophonic signal is added to the left and right signals.

As a result, when a user listens to it as music, the stereo effect is missing or degraded.

To compensate for this omission of stereo effect, it is necessary to use an expensive member having a high performance as a DSP (Digital Signal Processor) constituting the signal processing circuit, or to use the combination of a general DSP and an external memory and use all-pass filters 41 to 44 to enhance the stereo effect. The construction increases the price of the device and complicates the construction.

Accordingly, the present invention has an object to realize a stereo signal processing apparatus capable of effectively removing vocal signals without degradation of stereo effect, with a simple construction.

(1) The invention described in claim 1 is a stereo signal processing apparatus, which removes vocal signals included in right and left input signals, comprising: right filter means for extracting a right low-frequency signal and a right high-frequency signal from a right input signal; left filter means for extracting a left low-frequency signal and a left high-frequency signal from a left input signal; subtraction means for performing subtraction between the right input signal and the left input signal so as to generate a vocal removal signal; right addition means for adding the right low-frequency signal and the right high-frequency signal from the subtraction means to the vocal removal signal from the subtraction means so as to generate a right output signal; left addition means for adding the left low-frequency signal and the left high-frequency signal from the left filter means to the vocal removal signal from the subtraction means so as to generate a left output signal, wherein the right filter means and the left filter means comprise filters having different filter types.

In the stereo signal processing apparatus, filters respectively constituting the right filter means and the left filter means have filter types different from each other, and group-delay characteristics of the respective filters are different from each other. In the right output signal and the left output signal, different delay periods (phase differences) in accordance with frequency can be obtained.

Accordingly, a stereo signal processing apparatus capable of effectively removing vocal signals without degradation of stereo effect with a simple construction can realized.

(2) The invention described in claim 2 is the stereo signal processing apparatus according to claim 1, wherein the right filter means comprises a right low-pass filter to extract the right low-frequency signal from the right input signal and a right high-pass filter to extract the right high-frequency signal from the right input signal, while the left filter means comprises a left high-pass filter to extract the left high-frequency signal from the left input signal and a left low-pass filter to extract the left low-frequency signal from the left input signal, and wherein the right low-pass filter and the left low-pass filter have filter types different from each other, and the right high-pass filter and the left high-pass filter have filter types different from each other.

In the stereo signal processing apparatus, filters respectively constituting the right low-pass filter and the left low-pass filter have filter types different from each other, and filters respectively constituting the right high-pass filter and the left high-pass filter have filter types different from each other. As group-delay characteristics of the respective filters are different from each other, in the right output signal and the left output signal, different delay periods (phase differences) in accordance with frequency can be obtained.

Accordingly, a stereo signal processing apparatus capable of effectively removing vocal signals without degradation of stereo effect with a simple construction can be realized.

(3) The invention described in claim 3 is the stereo signal processing apparatus according to claim 2, wherein the filters having different types are Chebyshev type filters and Inverse Chebyshev type filters.

In the stereo signal processing apparatus, filters respectively constituting the right filter means and the left filter means have filter types different from each other (Chebyshev type and Inverse Chebyshev type), and group-delay characteristics of the respective filters are different from each other. In the right output signal and the left output signal, different group-delay periods (phase differences) in accordance with frequency can be obtained. Further, as the filter types are Chebyshev type and Inverse Chebyshev type, though the delay periods are different, the signal levels are approximately the same.

Accordingly, a stereo signal processing apparatus capable of effectively removing vocal signals without degradation of stereo effect with a simple construction can be realized.

Hereinbelow, an embodiment of the present invention will be described in detail. Note that in the present embodiment, description will be made using a stereo signal processing apparatus having a vocal cancel function to remove vocal signals included in left and right input signals as a particular example.

Next, a stereo signal processing apparatus 100 will be described with reference to FIG. 1. In FIG. 1, the stereo signal processing apparatus 100 has a left low-pass filter 111 that extracts a left low-frequency signal and a left high-pass filter 112 that extracts a left high-frequency signal, from a left input signal (Lin), a right low-pass filter 121 that extracts a right low-frequency signal and a right high-pass filter 122 that extracts a right high-frequency signal, from a right input signal (Rin), subtraction means 131 that performs subtraction between the right input signal (Rin) and the left input signal (Lin) to generate a vocal removal signal, left addition means 113 that adds the left low-frequency signal and the left high-frequency signal to the vocal removal signal to generate a left output signal (Lout), and right addition means 123 that adds the right low-frequency signal and the right high-frequency signal to the vocal removal signal to generate a right output signal (Rout).

In the stereo signal processing apparatus, filters respectively constituting the right filter means and the left filter means have filter types different from each other.

In the stereo signal processing apparatus, in the left filter means (111, 112) and the right filter means (121, 122), cutoff frequencies and cutoff characteristics are approximately the same, however, the filters respectively constituting the filter means have filter types different from each other, and group-delay periods (phase differences) of the respective filters are different from each other. In the right output signal and the left output signal, different delay periods (phase differences) in accordance with frequency can be obtained.

Preferably, in the stereo signal processing apparatus, the filter type of the left low-pass filter 111 and that of the right low-pass filter 121 are different from each other, and the filter type of the left high-pass filter 112 and that of the right high-pass filter 122 are different from each other. Accordingly, in the right output signal and the left output signal, different delay periods (phase differences) in accordance with frequency can be obtained by the different group-delay characteristics of the respective filters.

Further preferably, in the stereo signal processing apparatus, the right and left filters are constituted respectively with Chebyshev type and Inverse Chebyshev type filters. Accordingly, in the right output signal and the left output signal, different delay periods (phase differences) in accordance with frequency can be obtained by the difference between the group-delay characteristics of the respective filters. Further, as the filters are of Chebyshev type and Inverse Chebyshev type, though the delay periods are different, the signal levels are approximately the same.

Then, stereo signals as Lin and Rin are inputted. First, the left and right filter extract a low-frequency signal and a high-frequency signal except an intermediate frequency including a vocal signal. At this stage, as the low-frequency signal and the high-frequency signal pass through the filter, though the vocal signal is not included, an intermediate component significant as music is missing.

Then, subtraction between the left input signal and the right input signal is performed by the subtractor 131, and a vocal removal signal, where the vocal signal precisely located around the center of the stereo signal is canceled and various plays precisely located without the center remain, is generated. In the vocal removal signal, though the vocal signal is canceled, signal components of various plays having phases different in left and right signals remain.

Then, the left addition means 113 adds the left low-frequency signal and the left high-frequency signal to the vocal removal signal, to generate a left output signal where all the frequency components are included and the vocal signal is removed.

Similarly, the right addition means 123 adds the right low-frequency signal and the right high-frequency signal to the vocal removal signal, to generate a right output signal where all the frequency components are included and the vocal signal is removed.

In the above circuit, to cancel the vocal signals, although the intermediate component significant as music is generated by the subtraction means 131, and the single signal is added to the left and right signals, as the left filter means 111, 112 and the right filter means 121, 122 use filters of different filter types, the group-delay characteristics of the filters are different from each other, and different delay periods (phase differences) in accordance with frequency can be obtained in the right output signal and the left output signal.

Regarding the delay periods, FIG. 2 and the subsequent figures show frequencies and characteristics of delay periods of the respective filters. In this case, a cutoff frequency of the low-pass filter is 200 Hz, and a cutoff frequency of the high-pass filter is 6 kHz.

FIG. 2 shows the characteristic of a Chebyshev type low-pass filter, in which the delay period at the cutoff frequency 200 Hz is 29.818 ms. FIG. 3 shows the characteristic of a Inverse Chebyshev type low-pass filter, in which the delay period at the cutoff frequency 200 Hz is 8.3749 ms. FIG. 4 shows the characteristic of a Chebyshev type high-pass filter, in which the delay period at the cutoff frequency 6 kHz is 3.1530 ms. FIG. 5 shows the characteristic of an Inverse Chebyshev type high-pass filter, in which the delay period at the cutoff frequency 6 kHz is 0.6095 ms.

As described above, since the delay periods around the cutoff frequencies are different and, as shown in the figures, the delay period changes in accordance with frequency, the phase changes in accordance with frequency in left and right signals, and the stereo effect increases. In this point, different from a case where a general delay device is inserted in any of left and right filters, an excellent result regarding the stereo effect can be obtained.

Further, in the stereo signal processing apparatus, the left and right filters of the Chebyshev type and the Inverse Chebyshev type are used, although the delay periods are different, the signal levels are approximately the same, thus no unnatural feeling occurs in sense of hearing.

As a result, leftward/rightward spreading feeling in low-frequency and high-frequency regions increases in comparison with the original stereo signal, and the lack or degradation of stereo effect by the influence of vocal-removing signal processing can be avoided.

Further, in the stereo signal processing apparatus, the expensive DSP and the external memory or all-pass filters necessary to compensate for the lack of stereo effect in the conventional apparatus are unnecessary. Thus the problem that the apparatus becomes complicated and becomes expensive can be avoided.

Accordingly, a stereo signal processing apparatus capable of effectively removing vocal signals without degradation of stereo effect with a simple construction can be realized.

Note that in the above description, the Chebyshev type and the Inverse Chebyshev type filters are employed, however, the filters are not limited to these types, and the combination of filters of other types may be used. In such case, it is desirable for omitting level matching to combine filters having different group-delay characteristics without signal level difference.

FIG. 6 shows an example of the characteristic of a low-pass filter of Butterworth type as a low-pass filter other then the Chebyshev type and the Inverse Chebyshev type filters, in which the delay period at the cutoff frequency 200 Hz is 16.545 ms. Accordingly, it is possible to combine this filter with the above-described Chebyshev type low-pass filter or to combine this filter with the Inverse Chebyshev type low-pass filter.

Further, the stereo effect can be enhanced by using filters where the cutoff frequency is changed in left and right filters to cause a phase difference around the cutoff frequencies. Note that in a case where the signal levels are different, level matching must be performed.

As described in detail with the embodiment, in the stereo signal processing to extract a right low-frequency signal and a right high-frequency signal from a right input signal, extract a left low-frequency signal and a left high-frequency signal from a left input signal, perform subtraction between the right input signal and the left input signal to generate a vocal removal signal, add the right low-frequency signal and the right high-frequency signal to the vocal removal signal to generate a right output signal, and add the left low-frequency signal and the left high-frequency signal to the vocal removal signal to generate a left output signal, as the right filter means and the left filter means have filter types different from each other, different delay periods (phase differences) in accordance with frequency can be obtained in the right output signal and the left output signal. Thus a stereo signal processing apparatus capable of effectively removing vocal signals without degradation of stereo effect with a simple construction can be realized.

100 Stereo signal processing apparatus

111 Left low-pass filter

112 Left high-pass filter

113 Left addition means

121 Right low-pass filter

122 Right high-pass filter

123 Right addition means

131 Subtraction means

Figure 1:
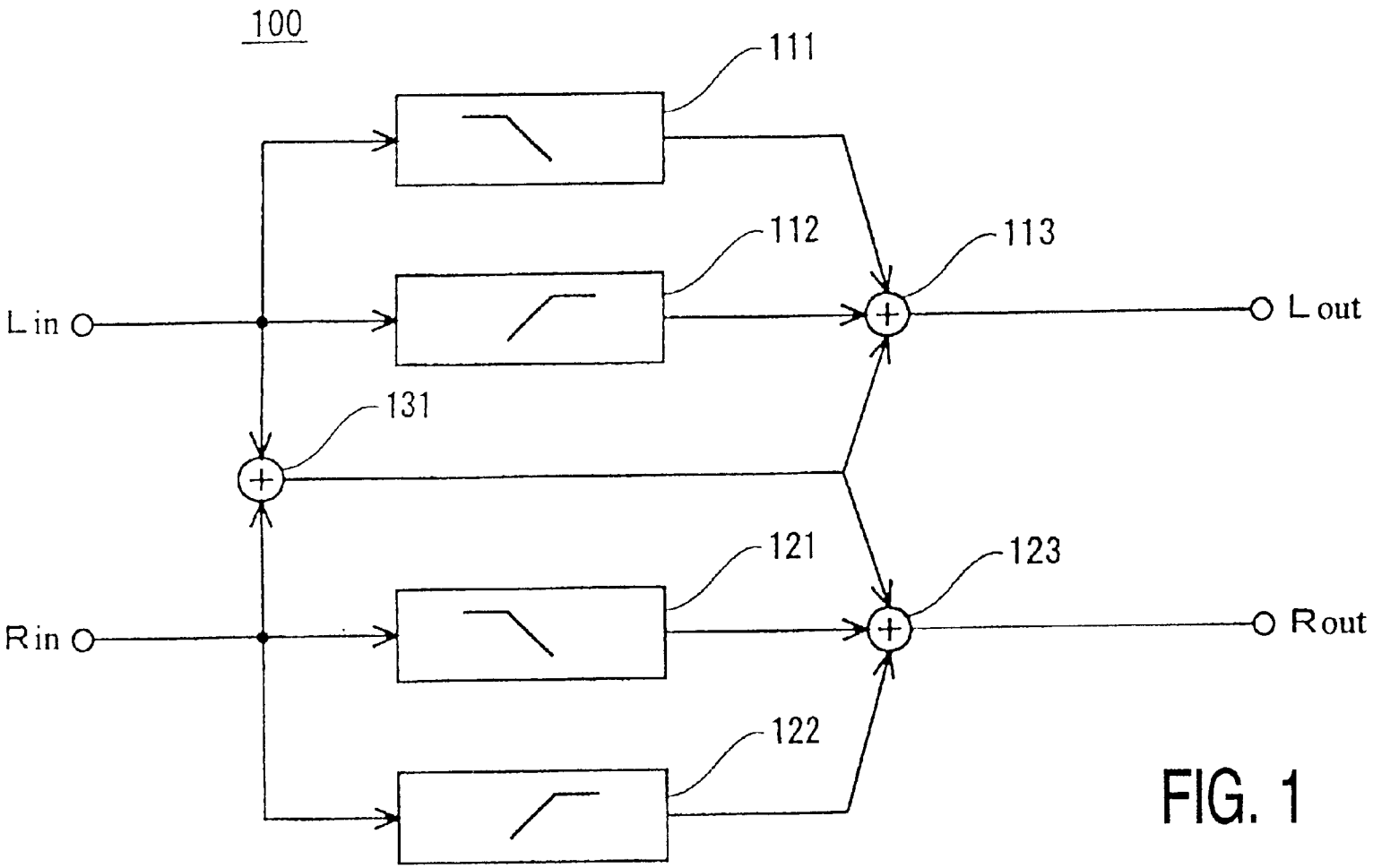
FIG. 1, a functional block diagram showing the construction of the stereo signal processing apparatus according to the embodiment of the present invention.
Figure 2:
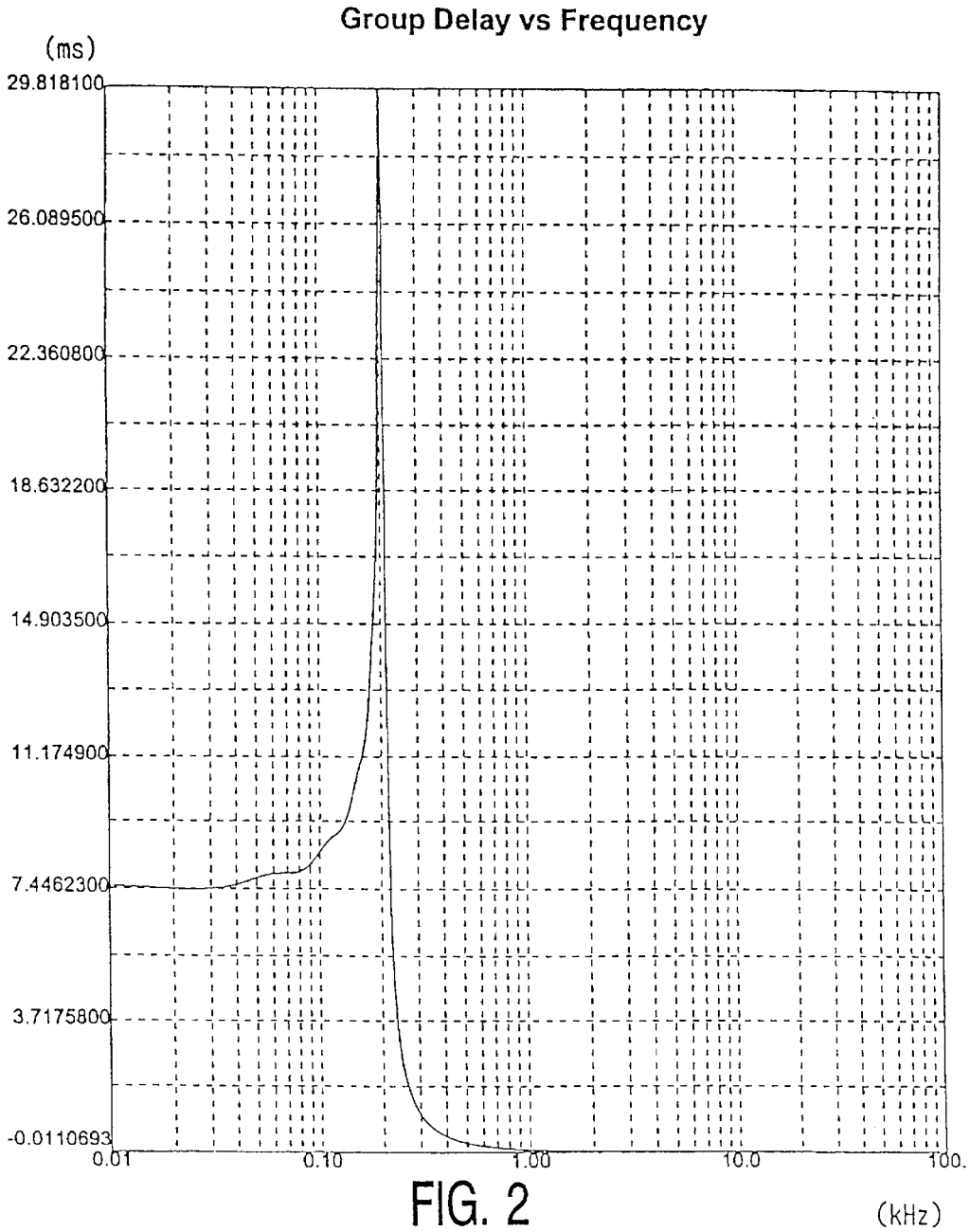
FIG. 2, a characteristic diagram showing the characteristic of the filter used in the embodiment of the present invention.
Figure 3:
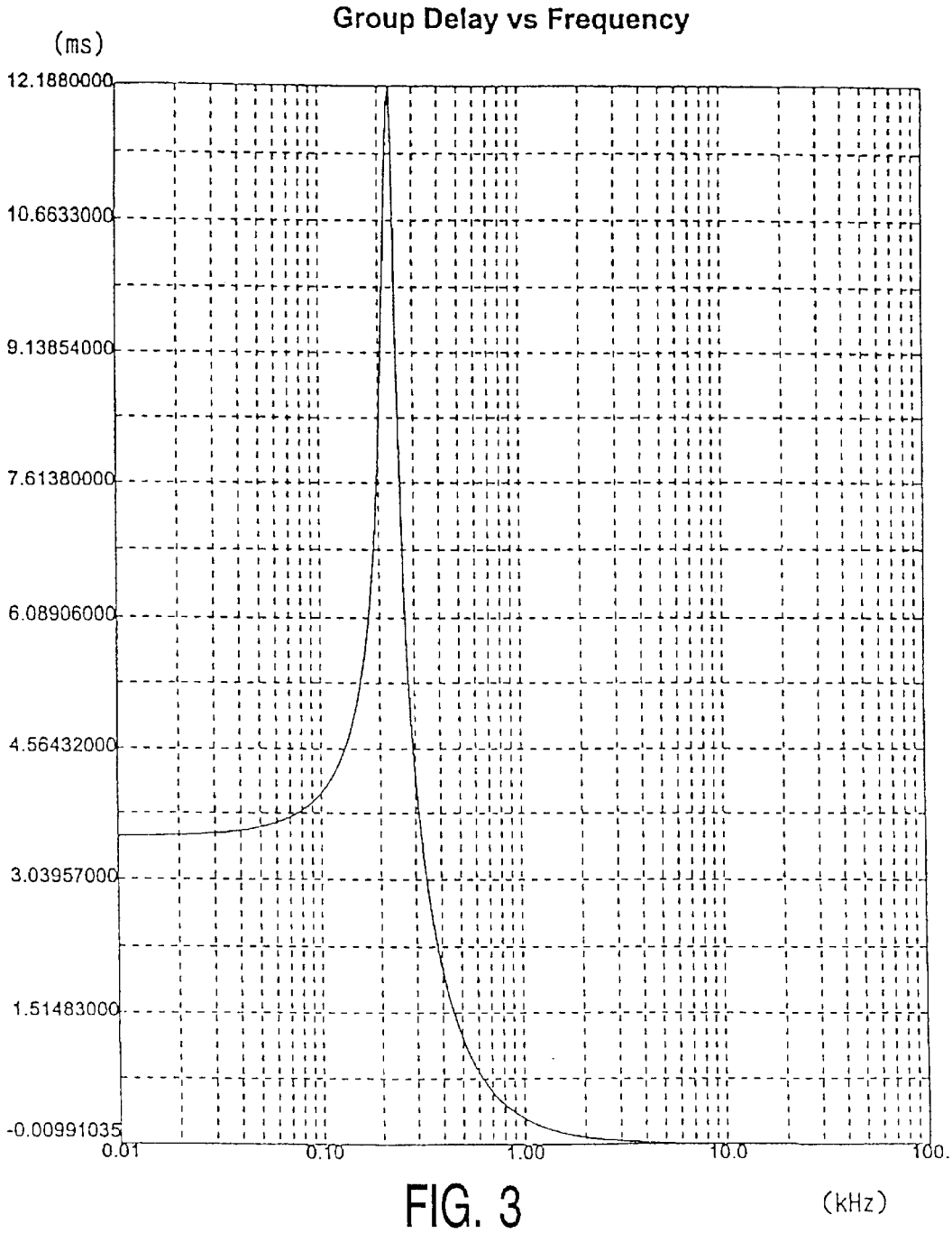
FIG. 3, a characteristic diagram showing the characteristic of the filter used in the embodiment of the present invention.
Figure 4:
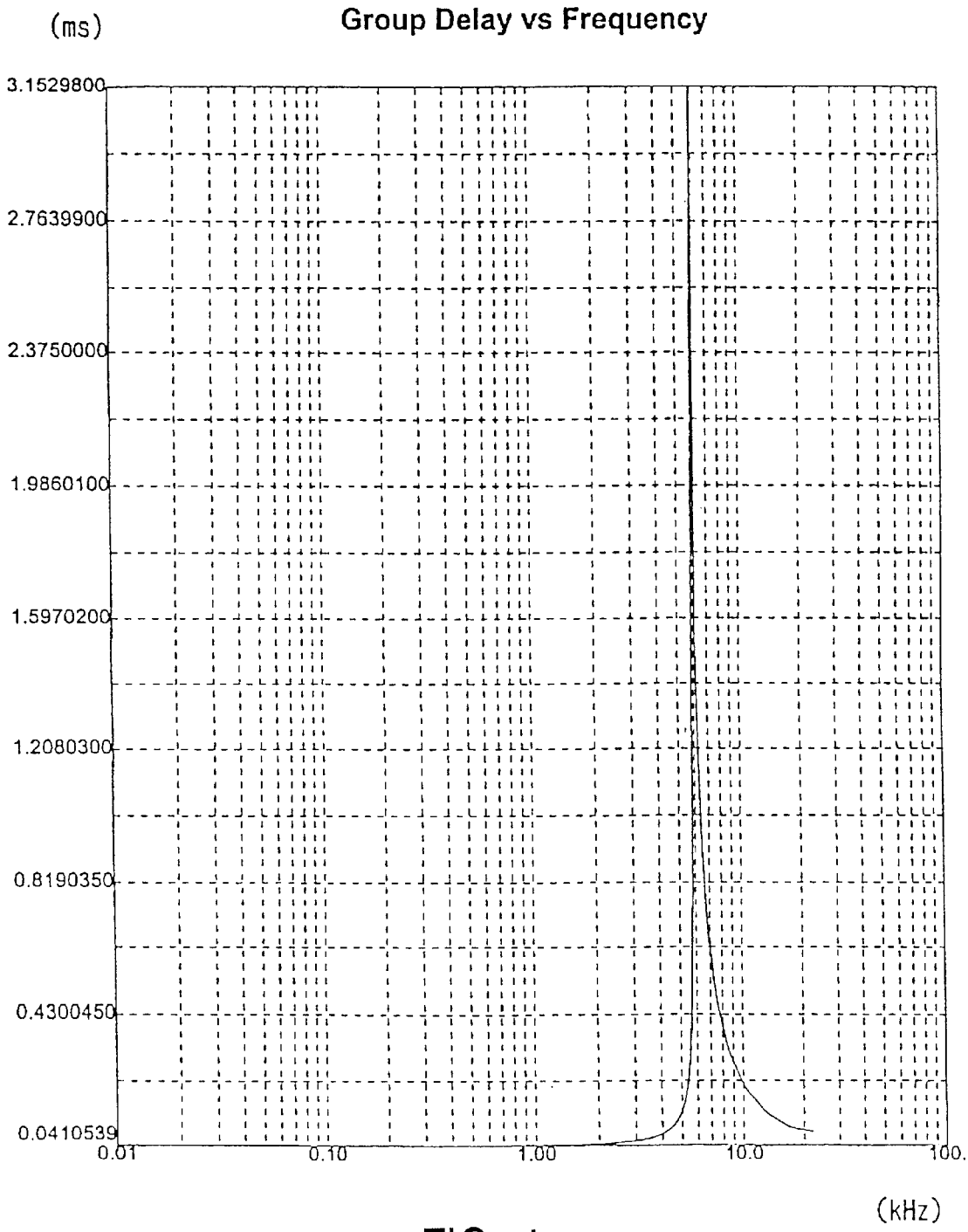
FIG. 4, a characteristic diagram showing the characteristic of the filter used in the embodiment of the present invention.
Figure 5:
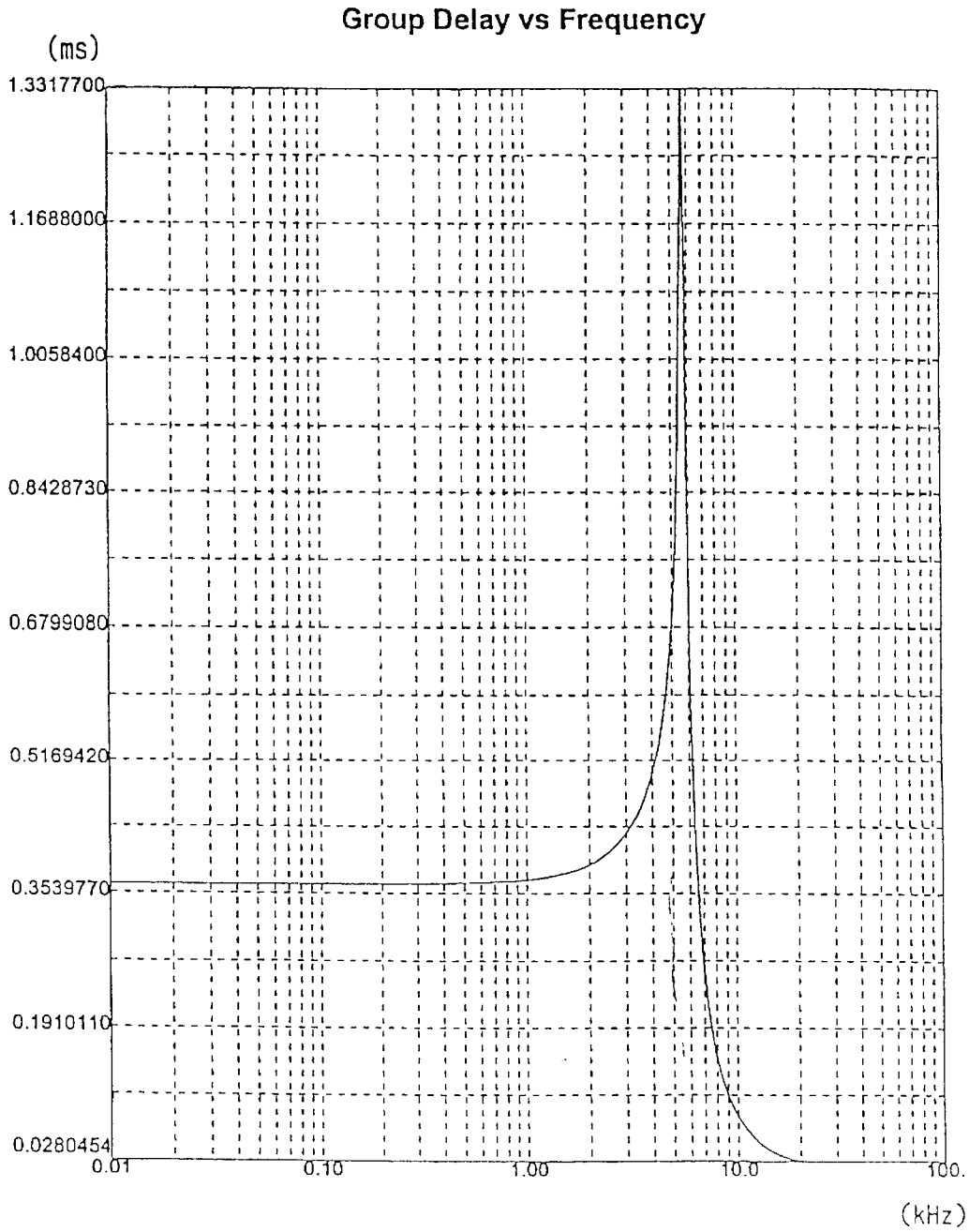
FIG. 5, a characteristic diagram showing the characteristic of the filter used in the embodiment of the present invention.
Figure 6:
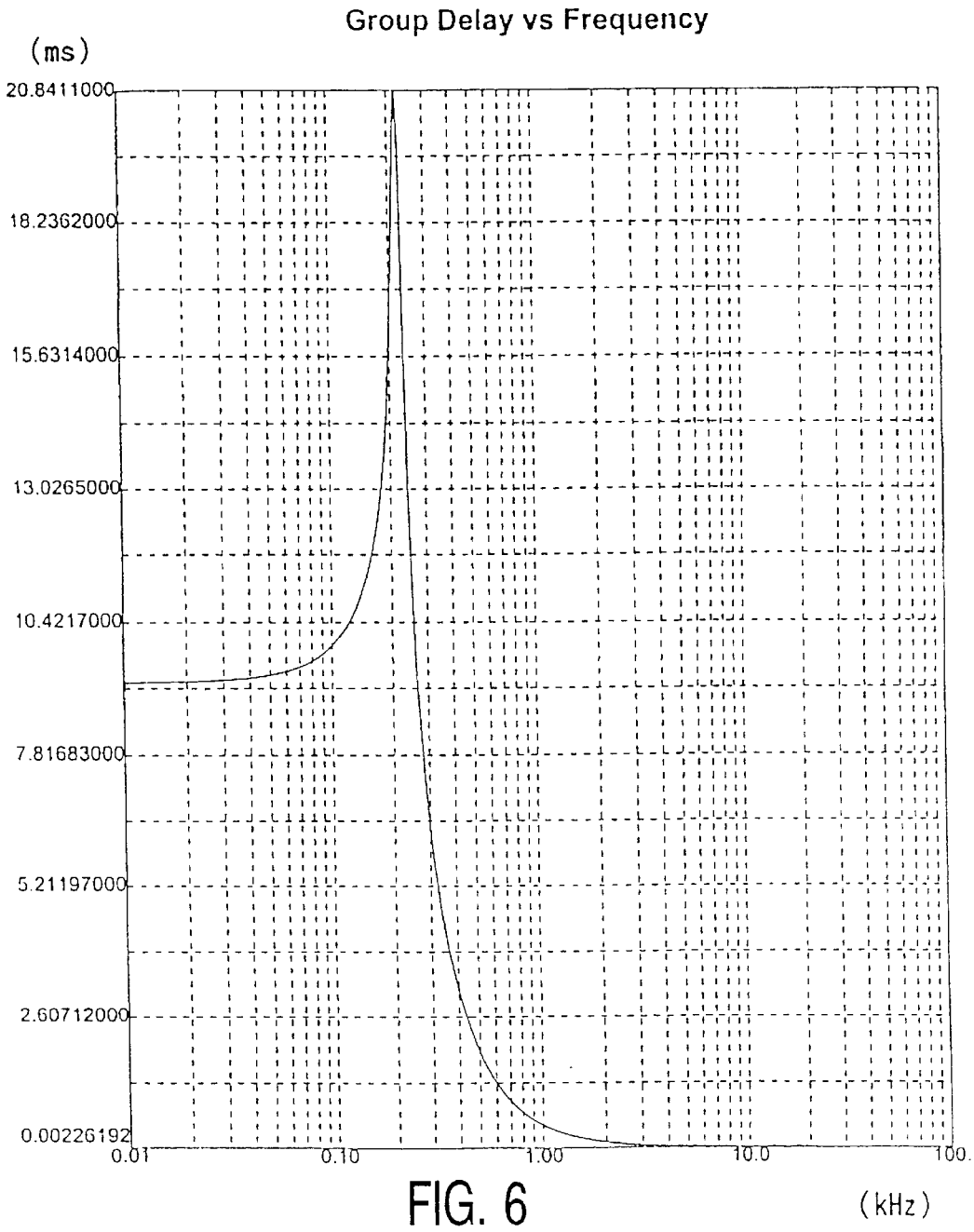
FIG. 6, a characteristic diagram showing the characteristic of another filter used in the embodiment of the present invention.
Figure 7:
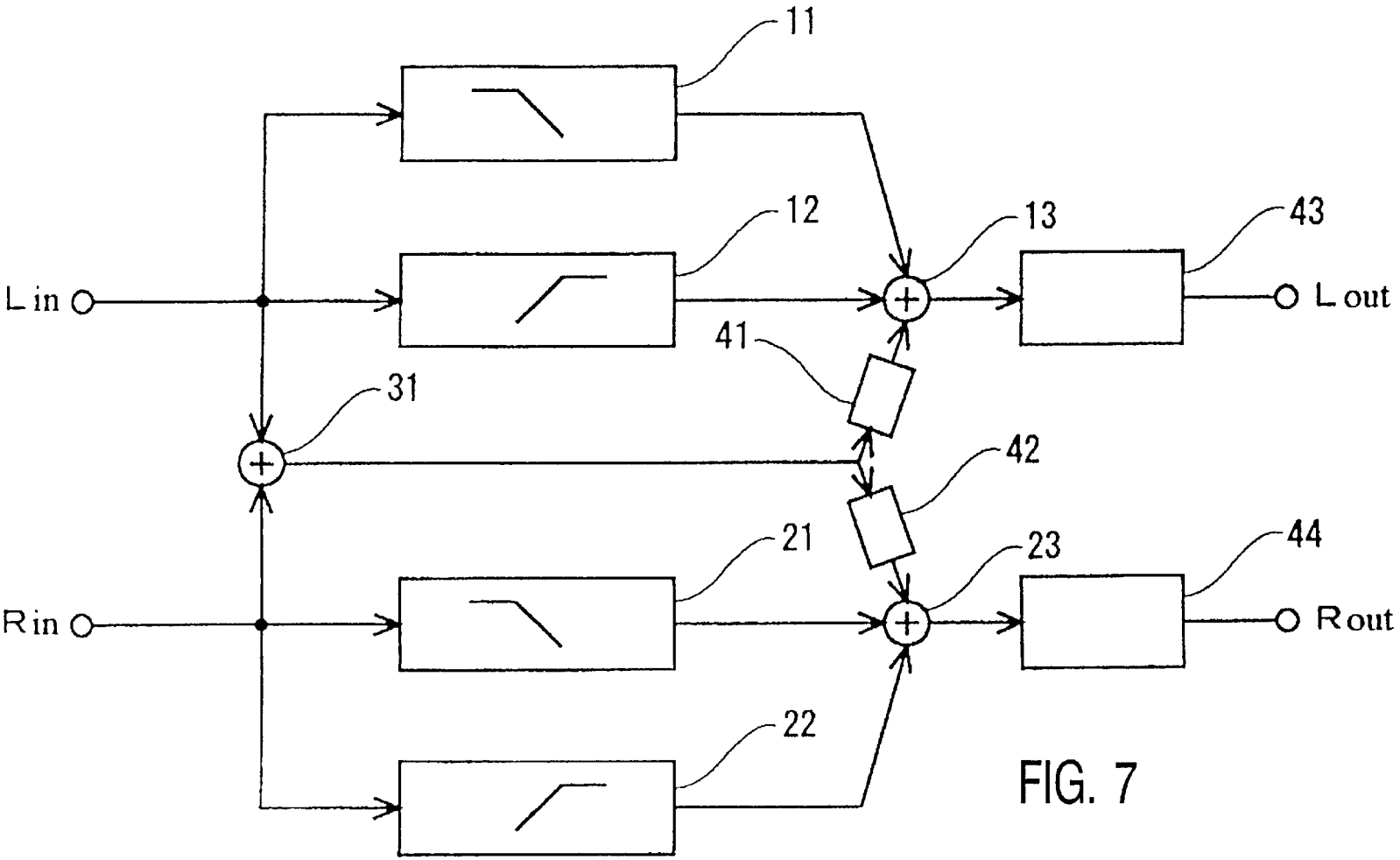
FIG. 7, a block diagram showing the construction of the conventional stereo signal processing apparatus.

What is claimed is:

1. A stereo signal processing apparatus, which removes vocal signals included in right and left input signals, comprising:

right filter means for extracting a right low-frequency signal and a right high-frequency signal from a right input signal;

left filter means for extracting a left low-frequency signal and a left high-frequency signal from a left input signal;

subtraction means for performing subtraction between the right input signal and the left input signal so as to generate a vocal removal signal;

right addition means for adding the right low-frequency signal and the right high-frequency signal from said right filter means to the vocal removal signal from said subtraction means so as to generate a right output signal;

left addition means for adding the left low-frequency signal and the left high-frequency signal from said left filter means to the vocal removal signal from said subtraction means so as to generate a left output signal, wherein said right filter means and said left filter means comprise filters having different filter types.

2. The stereo signal processing apparatus according to claim 1, wherein said right filter means comprises a right low-pass filter to extract the right low-frequency signal from the right input signal and a right high-pass filter to extract the right high-frequency signal from the right input signal, while said left filter means comprises a left high-pass filter to extract the left high-frequency signal from the left input signal and a left low-pass filter to extract the left low-frequency signal from the left input signal, and wherein said right low-pass filter and said left low-pass filter have filter types different from each other, and said right high-pass filter and said left high-pass filter have filter types different from each other.

3. The stereo signal processing apparatus according to claim 2, wherein said filters having different types are Chebyshev type filters and Inverse Chebyshev type filters.

* * * * *